US008000485B2

(12) United States Patent
Walsh et al.

(10) Patent No.: US 8,000,485 B2
(45) Date of Patent: Aug. 16, 2011

(54) VIRTUAL AUDIO PROCESSING FOR LOUDSPEAKER OR HEADPHONE PLAYBACK

(75) Inventors: Martin Walsh, Scotts Valley, CA (US); William Paul Smith, Bangor (GB); Jean-Marc Jot, Aptos, CA (US)

(73) Assignee: DTS, Inc., Calabasas, CA (US)

( * ) Notice: Subject to any disclaimer, the term of this patent is extended or adjusted under 35 U.S.C. 154(b) by 9 days.

(21) Appl. No.: 12/762,915

(22) Filed: Apr. 19, 2010

(65) Prior Publication Data

US 2010/0303246 A1 Dec. 2, 2010

Related U.S. Application Data

(60) Provisional application No. 61/217,562, filed on Jun. 1, 2009.

(51) Int. Cl.
*H04R 5/02* (2006.01)
*H04R 5/00* (2006.01)

(52) U.S. Cl. ..... 381/309; 381/27

(58) Field of Classification Search ..... 381/309, 381/27, 310, 303, 17–19, 61
See application file for complete search history.

(56) References Cited

U.S. PATENT DOCUMENTS 5,426,702 A * 6/1995 Aarts ..... 381/27
6,928,169 B1 8/2005 Aylward
2004/0005066 A1 1/2004 Kraemer
2007/0147623 A1* 6/2007 Kim et al. ..... 381/19
2007/0154019 A1* 7/2007 Kim ..... 381/17
2007/0297519 A1 12/2007 Thompson et al.
2008/0031462 A1 2/2008 Walsh et al.
2008/0037796 A1 2/2008 Jot et al.
2008/0056503 A1 3/2008 McGrath
2008/0126086 A1 5/2008 Vos et al.
2009/0092259 A1 4/2009 Jot et al.
2009/0252356 A1 10/2009 Goodwin et al.
2009/0304189 A1 12/2009 Vinton
2010/0119081 A1 5/2010 Aylward

OTHER PUBLICATIONS

International Search Report and Written Opinion issued in Corresponding International Application No. PCT/US2010/036683.
AES Convention Paper "Center-Channel Processing In Virtual 3-D Audio Reproduction over Headphones or Loudspeakers." Presented at the 128th Convention, May 22-25, 2010, London UK.

* cited by examiner

*Primary Examiner* — Ping Lee
(74) *Attorney, Agent, or Firm* — Gaurav K. Mohindra; William L. Johnson

(57) ABSTRACT

There are provided methods and an apparatus for processing audio signals. According to one aspect of the present invention there is included a method for processing audio signals having the steps of receiving at least one audio signal having at least a center channel signal, a right side channel signal, and a left side channel signal; processing the right and left side channel signals with a first virtualizer processor, thereby creating a right virtualized channel signal and a left virtualized channel signal; processing the center channel signal with a spatial extensor to produce distinct right and left outputs, thereby expanding the center channel with a pseudo-stereo effect; and summing the right and left outputs with the right and left virtualized channel signals to produce at least one modified side channel output.

10 Claims, 5 Drawing Sheets

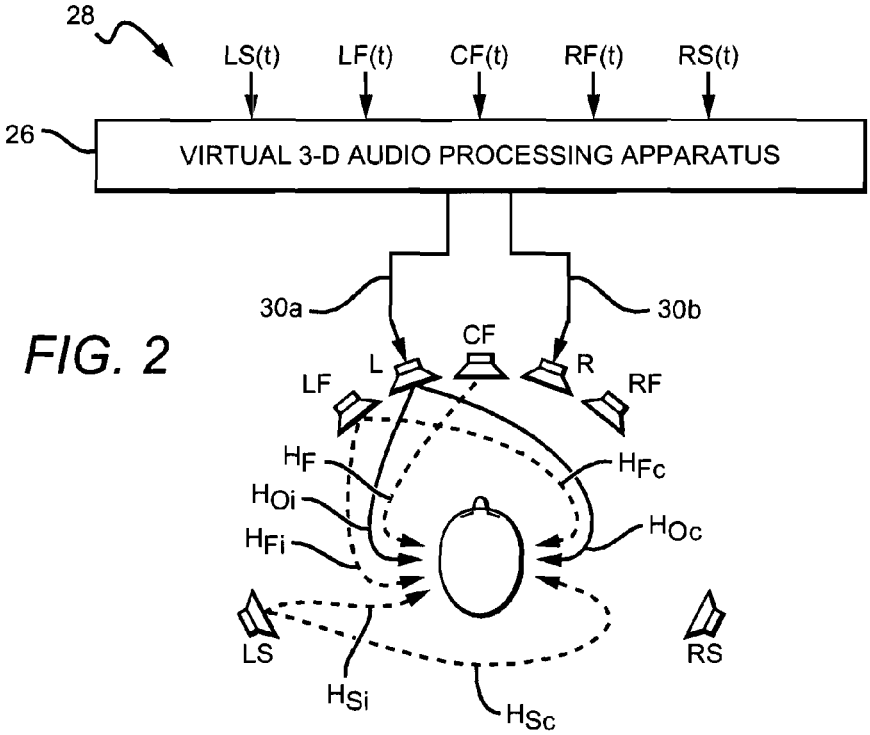
FIG. 2
FIG. 3a
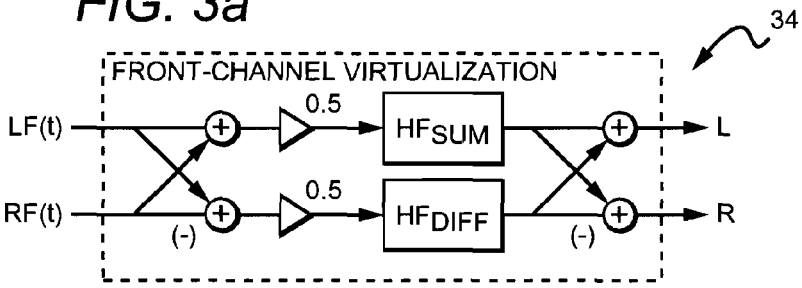
FIG. 3b
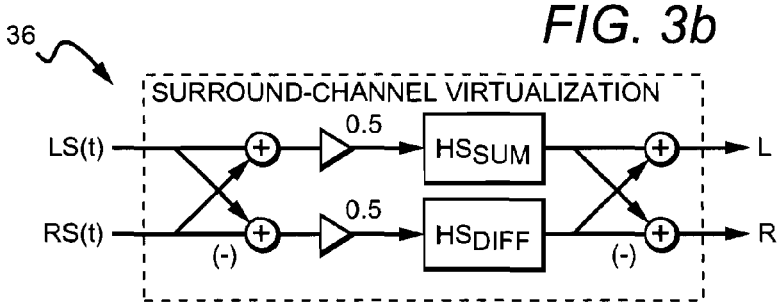

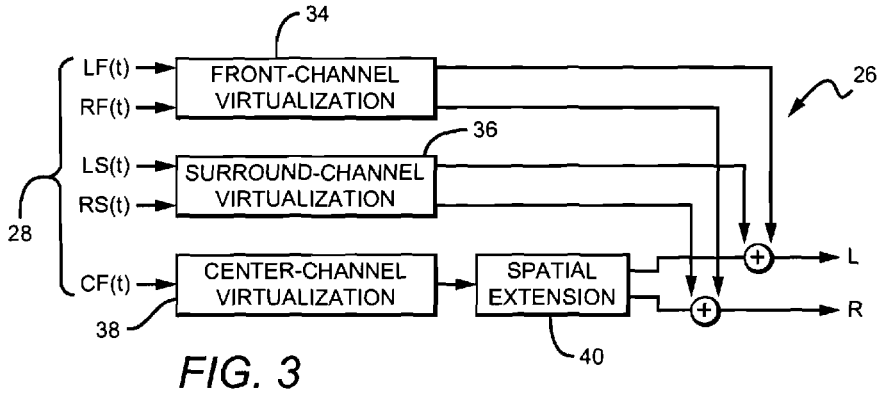
FIG. 3
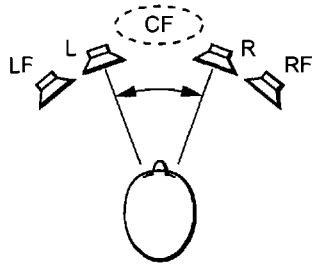
FIG. 4
FIG. 5a
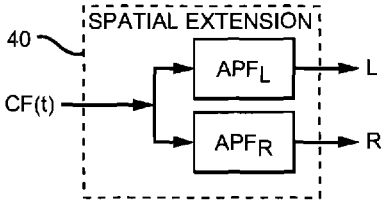
FIG. 5b
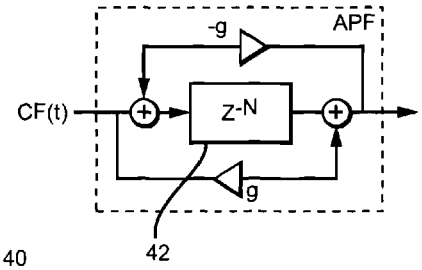
FIG. 5c
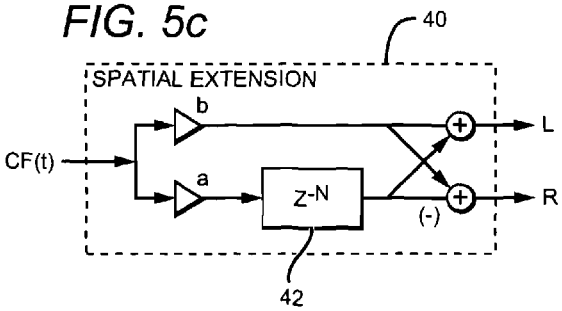

VIRTUAL AUDIO PROCESSING FOR LOUDSPEAKER OR HEADPHONE PLAYBACK

CROSS-REFERENCE TO RELATED APPLICATIONS

The present invention claims priority of U.S. Provisional Patent Application Ser. No. 61/217,562 filed Jun. 1, 2009, entitled VIRTUAL 3D AUDIO PROCESSING FOR LOUDSPEAKER OR HEADPHONE PLAYBACK, to inventors Walsh et al. U.S. Provisional Patent Application Ser. No. 61/217,562 is hereby incorporated herein by reference.

STATEMENT RE: FEDERALLY SPONSORED RESEARCH/DEVELOPMENT

Not Applicable

BACKGROUND

1. Technical Field

The present invention relates to processing audio signals, more particularly, to processing audio signals reproducing sound on virtual channels.

2. Description of the Related Art

Audio plays a significant role in providing a content rich multimedia experience in consumer electronics. The scalability and mobility of consumer electronic devices along with the growth of wireless connectivity provides users with instant access to content. FIG. 1*a* illustrates a conventional audio reproduction system 10 for playback over headphones 12 or a loudspeaker 14 that is well understood by those skilled in the art.

A conventional audio reproduction system 10 receives digital or analog audio source signal 16 from various audio or audio/video sources 18, such as a CD player, a TV tuner, a handheld media player, or the like. The audio reproduction system 10 may be a home theater receiver or an automotive audio system dedicated to the selection, processing, and routing of broadcast audio and/or video signals. Alternatively, the audio reproduction system 10 and one or several audio signal sources may be incorporated together in a consumer electronics device, such as a portable media player, a TV set, a laptop computer, or the like.

An audio output signal 20 is generally processed and output for playback over a speaker system. Such output signals 20 may be two-channel signals sent to headphones 12 or a pair of frontal loudspeakers 14, or multi-channel signals for surround sound playback. For surround sound playback, the audio reproduction system 10 may include a multichannel decoder as described in U.S. Pat. No. 5,974,380 assigned to Digital Theater Systems, Inc. (DTS) hereby incorporated herein by reference. Other commonly used multichannel decoders include DTS-HD® and Dolby® AC3.

The audio reproduction system 10 further includes standard processing equipment (not shown) such as analog-to-digital converters for connecting analog audio sources, or digital audio input interfaces. The audio reproduction system 10 may include a digital signal processor for processing audio signals, as well as digital-to-analog converters and signal amplifiers for converting the processed output signals to electrical signals sent to the transducers (headphones 12 or loudspeakers 14).

Generally, loudspeakers 14 may be arranged in a variety of configurations as determined by various applications. Loudspeakers 14 may be stand alone speakers as depicted in FIG. 1*a*. Alternatively, loudspeakers 14 may be incorporated in the same device, as in the case of consumer electronics such as a television set, laptop computers, hand held stereos, or the like. FIG. 1*b* illustrates a laptop computer 22 having two encased speakers 24*a*, 24*b* positioned parallel to each other. The encased speakers are narrowly spaced apart from each other as indicated by a'. Consumer electronics may include encased speakers 24*a*, 24*b* arranged in various orientations such as side by side, or top and bottom. The spacing and sizing of the encased speakers 24*a*, 24*b* are application specific, thus dependent upon the size and physical constraints of the casing.

Due to technical and physical constraints, oftentimes audio playback is compromised or limited in such devices. This is particularly evident in electronic devices having physical constraints where speakers are narrowly spaced apart, or where headphones are utilized to playback sound, such as in laptops, MP3 players, mobile phones and the like. Some devices are limited due to the physical separation between speakers and because of a correspondingly small angle between the speakers and the listener. In such sound systems the width of the perceived sound stage is generally perceived by the listener as inferior to that of systems having adequately spaced speakers. Oftentimes product designers abstain from deviating from a television's aesthetic design by not including a center mounted speaker. This compromise may limit the overall sound quality of the television as speech and dialogue are directed to the center speaker.

To address these audio constraints, audio processing methods are commonly used for reproducing two-channel or multi-channel audio signals over a pair of headphones or a pair of loudspeakers. Such methods include compelling spatial enhancement effects to improve the audio playback in applications having narrowly spaced speakers.

In U.S. Pat. No. 5,671,287, Gerzon discloses a pseudo-stereo or directional dispersion effect with both low "phasiness" and a substantially flat reproduced total energy response. The pseudo-stereo effect includes minimal unpleasant and undesirable subjective side effects. It can also provide simple methods of controlling the various parameters of a pseudo-stereo effect such as the size of angular spread of sound sources.

In U.S. Pat. No. 6,370,256, McGrath discloses a Head Related Transfer Function on an input audio signal in a head tracked listening environment including a series of principle component filters attached to the input audio signal and each outputting a predetermined simulated sound arrival; a series of delay elements each attached to a corresponding one of the principle component filters and delaying the output of the filter by a variable amount depending on a delay input so as to produce a filter delay output; a summation means interconnected to the series of delay elements and summing the filter delay outputs to produce an audio speaker output signal; head track parameter mapping unit having a current orientation signal input and interconnected to each of the series of delay elements so as to provide the delay inputs.

In U.S. Pat. No. 6,574,649, McGrath discloses an efficient convolution technique for spatial enhancement. The time domain output adds various spatial effects to the input signals using low processing power.

Conventional spatial audio enhancement effects include processing audio signals to provide the perception that they are output from virtual speakers thereby having an outside the head effect (in headphone playback), or beyond the loudspeaker arc effect (in loudspeaker playback). Such "virtualization" processing is particularly effective for audio signals containing a majority of lateral (or 'hard-panned') sounds.

However, when audio signals contain center-panned sound components, the perceived position of center-panned sound components remains 'anchored' at the center-point of the loudspeakers. When such sounds are reproduced over headphones, they are often perceived as being elevated and may produce an undesirable "in the head" audio experience.

Virtual audio effects are less compelling for audio material that is less aggressively mixed for two-channel or stereo signals. In this regard, the center-panned components dominate the mix, resulting in minimal spatial enhancement. In an extreme case where the input signal is fully monophonic (identical in the left and right audio source channels), no spatial effect is heard at all when spatial enhancement algorithms are enabled.

This is particularly problematic in systems where loudspeakers are below a listener's ear level (horizontal listening plane). Such configurations are present in laptop computers or mobile devices. In these cases, the processed hard-panned components of the audio mix may be perceived beyond the loudspeakers and elevated above the plane of the loudspeakers, while the center-panned and/or monophonic content is perceived to originate from between the original loudspeakers. This results in a very 'disjointed' reproduced stereo image.

Therefore, in view of the ever increasing interest and utilization of providing spatial effects in audio signals, there is a need in the art for improved virtual audio processing.

BRIEF SUMMARY

According to one aspect of the present invention there is included a method for processing audio signals having the steps of receiving at least one audio signal having at least a center channel signal, a right side channel signal, and a left side channel signal; processing the right and left side channel signals with a first virtualizer processor, thereby creating a right virtualized channel signal and a left virtualized channel signal; processing the center channel signal with a spatial extensor to produce distinct right and left outputs, thereby expanding the center channel with a pseudo-stereo effect; and summing the right and left outputs with the right and left virtualized channel signals to produce at least one modified side channel output.

The center channel signal is filtered by right and left all-pass filters producing right and left phase shifted output signals. The right and left side channel signals are processed by the first virtualizer processor to create a different perceived spatial location for at least one of the right side channel signal and left side channel signal. In an alternative embodiment, the step of processing the center channel signal with a spatial extensor further comprises the step of applying a delay or an all-pass filter to the center channel signal, thereby creating a phase-shifted center channel signal. Subsequently, the phase-shifted center channel signal is subtracted from the center channel signal producing the right output. Afterwards, the phase-shifted center channel signal is added to the center channel signal producing the left output. In an alternative embodiment, the spatial extensor scales the center channel signal based on at least one coefficient which determines a perceived amount of spatial extension. The coefficient is determined by multiplication factors a and b verifying $a^2+b^2=c$; wherein c is equal to a predetermined constant value.

According to a second aspect of the present invention, a method is included for processing audio signals comprising the steps of receiving at least one audio signal having at least a right side channel signal and a left side channel signal; processing the right and left side channel signals to extract a center channel signal; further processing the right and left side channel signals with a first virtualizer processor, thereby creating a right virtualized channel signal and a left virtualized channel signal; processing the center channel signal with a spatial extensor to produce distinct left and right outputs, thereby expanding the center channel with a pseudo-stereo effect; and summing the right and left outputs with the right and left virtualized channel signals to produce at least one modified side channel output.

The first processing step may comprise the step of filtering the right and left side channel signals into a plurality of sub-band audio signals, each sub-band signal being associated with a different frequency band; extracting a sub-band center channel signal from each frequency band; and recombining the extracted sub-band center channel signals to produce a full-band center channel output signal. The first processing step may include the step of extracting the sub-band center channel signal by scaling at least one of the right or left sub-band side channel signals with at least one scaling coefficient. It is contemplated that the at least one scaling coefficient is determined by evaluating an inter-channel similarity index between the right and left side channel signals. The inter-channel similarity index is related to a magnitude of a signal component common to the right and left side channel signals.

According to a third aspect of the present invention, there is provided an audio signal processing apparatus comprising at least one audio signal having at least a center channel signal, a right side channel signal, and a left side channel signal; a processor for receiving the right and left side channel signals, the processor processing the right and left side channel signals with a first virtualizer processor, thereby creating a right virtualized channel signal and a left virtualized channel signal; a spatial extensor for receiving the center channel signal, the spatial extensor processing the center channel signal to produce distinct right and left output signals, thereby expanding the center channel with a pseudo-stereo effect; and a mixer for summing the right and left output signals with the right and left virtualized channel signals to produce at least one modified side channel output. The right and left side channel signals are processed with the first virtualizer processor to create a different perceived spatial location for at least one of the right side channel signal and left side channel signal. The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 2 is a schematic diagram illustrating a virtual audio processing apparatus for playback over a frontal pair of loudspeakers.

FIG. 3 is a block diagram of a virtual audio processing system having three parallel processing blocks and a spatial extensor included in the center channel processing block.

FIG. 3*a* is a block diagram of a front-channel virtualization processing block having HRTF filters with a sum and difference transfer function and the generation of two output signals.

FIG. 3*b* is a block diagram of a surround-channel virtualization processing block having HRTF filters with a sum and difference transfer function and generating two output signals.

FIG. 4 is a schematic diagram illustrating the auditory effect of spatial extension processing according to an embodiment of the invention.

FIG. 5*a* is a block diagram of the spatial extension processing block depicting the center channel signal being filtered by a right all pass filter and a left all pass filter.

FIG. 5*b* is a block diagram of an all pass filter including a delay unit.

FIG. 5*c* is a block diagram of a spatial extension processing block having a delay unit.

DETAILED DESCRIPTION

Figure 1A:
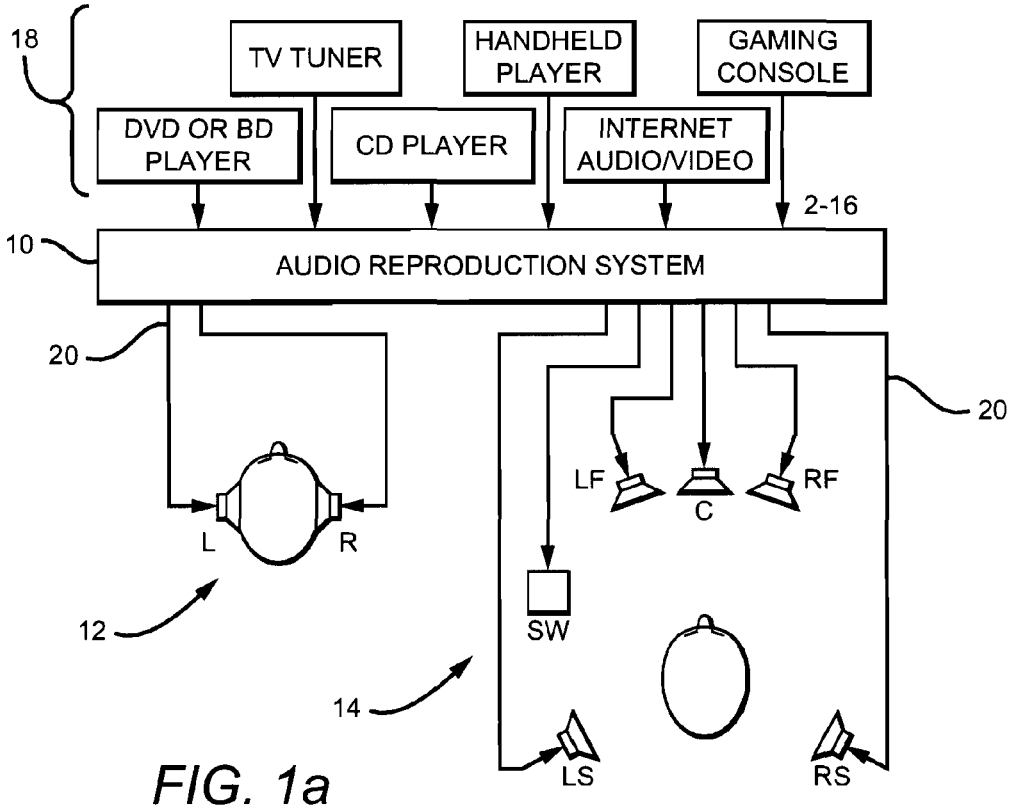
FIG. 1a PRIOR ART
FIG. 1*a* is a schematic diagram illustrating a conventional audio reproduction playback system for reproduction over headphones or loudspeakers.
Figure 1B:
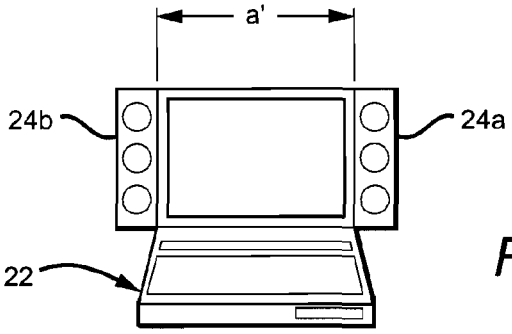
FIG. 1*b* is a schematic drawing illustrating a laptop computer having two encased speakers narrowly spaced apart.

In the following description, numerous specific details are set forth. However, it is understood that embodiments of the invention may be practiced without these specific details. In other instances, well-known circuits, structures, and techniques have not been shown in order not to obscure the understanding of this description.

Elements of one embodiment of the invention may be implemented by hardware, firmware, software or any combination thereof. When implemented in software, the elements of an embodiment of the present invention are essentially the code segments to perform the necessary tasks. The software may include the actual code to carry out the operations described in one embodiment of the invention, or code that emulates or simulates the operations. The program or code segments can be stored in a processor or machine accessible medium or transmitted by a computer data signal embodied in a carrier wave, or a signal modulated by a carrier, over a transmission medium. The "processor readable or accessible medium" or "machine readable or accessible medium" may include any medium that can store, transmit, or transfer information. Examples of the processor readable medium include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

The machine accessible medium may be embodied in an article of manufacture. The machine accessible medium may include data that, when accessed by a machine, cause the machine to perform the operation described in the following. The term "data" here refers to any type of information that is encoded for machine-readable purposes. Therefore, it may include program, code, data, file, etc.

All or part of an embodiment of the invention may be implemented by software. The software may have several modules coupled to one another. A software module is coupled to another module to receive variables, parameters, arguments, pointers, etc. and/or to generate or pass results, updated variables, pointers, etc. A software module may also be a software driver or interface to interact with the operating system running on the platform. A software module may also be a hardware driver to configure, set up, initialize, send and receive data to and from a hardware device One embodiment of the invention may be described as a process which is usually depicted as a flowchart, a flow diagram, a structure diagram, or a block diagram. Although a block diagram may describe the operations as a sequential process, many of the operations can be performed in parallel or concurrently. In addition, the order of the operations may be re-arranged. A process is terminated when its operations are completed. A process may correspond to a method, a program, a procedure, etc.

FIG. 2 is a schematic diagram illustrating an environment in which one embodiment of the invention can be practiced. The environment includes a virtual audio processing apparatus 26 configured to receive at least one audio source signal 28. The audio source signal 28 can be any audio signal such as a mono signal or a two-channel signal (such as a music track or TV broadcast). A two-channel audio signal includes two side channel signals LF(t), RF(t) intended for playback over a pair of frontal loudspeakers LF, RF. Alternatively, the audio source signal 28 may be a multi-channel signal (such as a movie soundtrack) and include a center channel signal CF(t) and four side channel signals LS(t), LF(t), RF(t), RS(t) intended for playback over a surround-sound loudspeaker array. It is preferred that the audio source signal 28 includes at least a left channel signal LF(t) and a right channel signal RF(t).

The virtual audio processing apparatus 26 processes audio source signals 28 to produce audio output signals 30*a*, 30*b* for playback over loudspeakers or headphones. An audio source signal 28 may be a multi-channel signal intended for performance over an array of loudspeakers 14 surrounding the listener, such as the standard '5.1' loudspeaker layout shown on FIG. 1*a*, with the loudspeakers labeled LS (Left Surround), LF (Left Front), CF (Center Front), RF (Right Front), RS (Right Surround), SW (Subwoofer). The standard '5.1' loudspeaker layout 14 is provided by way of example and not limitation. In this regard, it is contemplated that audio output signals 30*a*, 30*b* may be configured for simulating any source (or 'virtual') loudspeaker layout represented as 'm.n', where m is the number of main (satellite) channels and n is the number of subwoofer (or Low Frequency Enhancement) channels. Alternatively, the audio output signals 30*a*, 30*b* may be processed for playback over a pair of headphones 12.

The virtual audio processing apparatus 26 has various conventional processing means (not shown) which may include a digital signal processor connected to digital audio input and output interfaces and memory storage for the storage of temporary processing data and of processing program instructions.

The audio output signals 30*a*, 30*b* are directed to a pair of loudspeakers respectively labeled L and R. FIG. 2 depicts the intended placement of the loudspeakers LS, LF, CF, RF, and RS for a five-channel audio input signal. In many practical applications, such as TV sets or laptop computers, the physical spacing of the output loudspeakers L and R is narrower than the intended spacing of the LF and RF loudspeakers. In this case, the virtual audio processing apparatus 26 is designed to produce a stereo widening effect. The stereo widening effect provides the illusion that the audio signals LF(t) and RF(t) emanate from a virtual pair of loudspeakers located at positions LF and RF. Thus, it is perceived that sound emanates from virtual speakers positioned at the intended location of the speakers. A virtual loudspeaker may be positioned at any location on the spatial sound stage. In this regard, it is contemplated that audio source signals 28 may be processed to emanate from virtual loudspeakers at any perceived position.

For a five-channel audio source signal 28, the virtual audio processing apparatus 26 produces the perception that audio channel signals CF(t), LS(t) and RS(t) emanate from loudspeakers located respectively at positions CF, LS and RS. Likewise, audio channel signals CF(t), LF(t) and RF(t) may be perceived to emanate from loudspeakers located respectively at positions CF, LF, and RF. As is well-known in the art, these illusions may be achieved by applying transformations to the audio input signals 28 taking into account measurements or approximations of the loudspeaker-to-ear acoustic transfer functions, or Head Related Transfer Functions (HRTF). An HRTF relates to the frequency dependent time and amplitude differences that are imposed on the sound emanating from any sound source and are attributed to acoustic diffraction around the listener's head. It is contemplated that every source from any direction yields two associated HRTFs (one for each ear). It is important to note that most 3-D sound systems are incapable of using the HRTFs of the user; in most cases, nonindividualized (generalized) HRTFs are used. Usually, a theoretical approach, physically or psychoacoustically based, is used for deriving nonindividualized HRTFs that are generalizable to a large segment of the population.

The ipsilateral HRTF represents the path taken to the ear nearest the source and the contralateral HRTF represents the path taken to the farthest ear. The HRTFs denoted on FIG. 2 are as follow:

- $H_{0i}$: ipsilateral HRTF for the front left or right physical loudspeaker locations;
- $H_{0c}$: contralateral HRTF for the front left or right physical loudspeaker locations;
- $H_{Fi}$: ipsilateral HRTF for the front left or right virtual loudspeaker locations;
- $H_{Fc}$: contralateral HRTF for the front left or right virtual loudspeaker locations;
- $H_{Si}$: ipsilateral HRTF for the surround left or right virtual loudspeaker locations;
- $H_{Sc}$: contralateral HRTF for the surround left or right virtual loudspeaker locations;
- $H_F$: HRTF for front center virtual loudspeaker location (identical for the two ears);

The virtual audio processing apparatus assumes a symmetrical relationship between the physical and virtual loudspeaker layouts with respect to the listener's frontal direction. With a symmetrical relationship, a listener is positioned on a linear axis in relation to the CF speaker such that the audio image is directionally balanced. It is contemplated that slight changes in head positions will not disjoint the symmetrical relationship. A symmetrical relationship is provided by way of example and not limitation. In this regard, a person skilled in the art will understand that the present invention may extend to asymmetrical virtual loudspeaker layouts including an arbitrary number of virtual loudspeakers positioned at any perceived location on a sound stage.

In an exemplary embodiment of the present invention, the intended output speakers may be headphones 12. In this case, the actual output loudspeakers L and R are positioned at the ears of the listener. The transfer function $H_{0i}$, is the headphone transfer function and the transfer function $H_{0c}$, may be neglected.

Referring now to FIG. 3, a block diagram of the virtual audio processing apparatus 26 is shown. The overall processing is decomposed into three parallel processing blocks processing audio source signal channels 28, whose outputs signals are summed respectively to compute the final output signal L(t), R(t). Each audio source signal 28 is virtualized thereby providing the illusion that each source channel signal LF(t), RF(t), LS(t), RS(t), CF(t) is positioned at a different predetermined position in 3D space. However, to provide the intended spatial effect, only one of the side channel signals LF(t), RF(t), LS(t), RS(t) is required to be virtualized. Various virtualization techniques for surround loudspeakers of a 5.1-channel system are known in the art. In some systems, the LS(t) and RS(t) channels of the 5.1 surround mix may be binaurally processed so as to create virtual sources with the HRTF corresponding to approximately 110 degrees from the front on either side (the normal locations of the surround loudspeakers).

The front-channel virtualization processing block 34 processes the front-channel source audio signal pair LF(t), RF(t). The surround-channel virtualization processing block 36 processes the surround-channel source audio signal pair LS(t), RS(t). The center-channel virtualization processing block 38 processes the center-channel source audio signal CF(t).

For a frontal loudspeaker output, the center-channel virtualization processing block 38 may include a signal attenuation of 3 dB. For a headphone output, the center-channel virtualization processing block 38 may apply a filter to the source signal CF(t), defined by transfer function $[H_F/H_{0i}]$.

Referring now to FIGS. 3*a* and 3*b*, a block diagram depicting a preferred embodiment of the front-channel virtualization processing block 34 and of the surround-channel virtualization processing block 36 is shown. The present embodiment assumes symmetry of the physical and virtual loudspeaker layouts with respect to the listener's frontal direction. The blocks $HF_{SUM}$, $HF_{DIFF}$, $HS_{SUM}$, and $HS_{DIFF}$ represent filters with transfer functions defined respectively by:

$$HF_{SUM}=[H_{Fi}+H_{Fc}]/[H_{0i}+H_{0c}];$$

$$HF_{DIFF}=[H_{Fi}-H_{Fc}]/[H_{0i}-H_{0c}];$$

$$HS_{SUM}=[H_{Si}+H_{Sc}]/[H_{0i}+H_{0c}];$$

$$HS_{DIFF}=[H_{Si}-H_{Sc}]/[H_{0i}-H_{0c}].$$

Referring back to FIG. 3, the center-channel virtualization block 38 is followed by a spatial extension processing block 40 (or spatial extensor, described in further detail below), producing two distinct (L and R) output signals from a single-channel input signal CF(t), yielding a pseudo-stereo effect. A pseudo-stereo effect converts a mono signal to a two-channel or multi-channel output signal, thereby spreading a mono signal across a two-channel or multi-channel stage.

In frontal loudspeaker playback, the resulting subjective effect is the sense that the center-channel audio signal CF(t) emanates from an extended region of space located in the vicinity of the physical loudspeakers, as illustrated in FIG. 4. The resulting signal CF(t) is thus spread out or dispersed, thereby creating a more natural sound perception. In headphone playback, the resulting subjective effect is a more natural and externalized perception of the localization of the center-channel audio signal. The subjective effect is an improved frontal "out-of-head" perception, thereby mitigating a common drawback in headphone playback.

In FIG. 3, the center-channel virtualization processing block 38 is a single-input, single-output filter, thus it would be equivalent to modify the process of FIG. 3 by first applying the spatial extension processing to the input signal CF(t), and then applying center-channel virtualization processing identically to each of the two output signals L and R of the spatial extension processing block.

Now referring to FIG. 5*a*, a block diagram of a spatial extension processing block 40 is shown. The source signal CF(t) is split into left and right output signals L, R, which are processed by distinct all-pass filters $APF_L$ and $APF_R$. An all-pass filter is an electronic filter that passes all frequencies equally, but changes the phase relationship between various frequencies. Thus, an all-pass filter may provide a frequency dependent phase shift to a signal and/or vary its propagation delay with frequency. All pass filters are generally used to compensate for other undesired phase shifts that arise in a process, or for mixing with an unshifted version of the original signal to implement a notch comb filter. They may also be used to convert a mixed phase filter into a minimum phase filter with an equivalent magnitude response or an unstable filter into a stable filter with an equivalent magnitude response.

Referring now to FIG. 5*b*, a block diagram of an embodiment of an all-pass filter processing block APF is shown. The all-pass filter APF includes a delay unit 42 denoted as $Z^N$, for introducing a time delay to the center channel signal CF(t). The digital delay length N is expressed in samples and g denotes a positive or negative loop gain such that its magnitude $|g|<1.0$. It is preferred for the spatial extension processing block 40 to include a different digital delay length N for each all-pass filter APF, with a delay time duration between 3 and 5 ms. However, this range of time duration is not intended to be limiting, as the time duration may be determined according to various parameters.

Referring now to FIG. 5*c*, a block diagram of a spatial extension processing block 40 according to an alternative embodiment is shown. In this embodiment, the difference between the L and R output signals of the spatial extension processing block 40 is produced by adding and subtracting, respectively, to the audio source signal CF(t) a delayed copy of itself. It is preferred that the copied CF(t) signal includes a time delay having a digital delay length between 2 and 4 ms. For a given digital delay length N, the degree of spatial extension is determined by the scaling factors a and b. The scaling factors are generated according to the multiplication factor having the ratio a/b. It is preferred that the ratio a/b be comprised within [0.0, 1.0]. The total power of the output signals L and R can be constrained to match that of the input signal CF(t) by imposing the rule: $a^2+b^2=c$. It is contemplated that c is equal to a predetermined constant. It is preferred that c is equal to around 0.5.

Figure 5D:
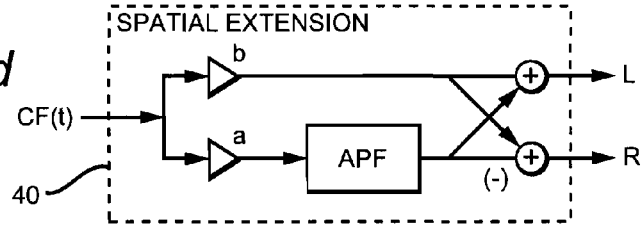
FIG. 5*d* is a block diagram of a spatial extension processing block having one all-pass filter.

Referring now to FIG. 5*d*, a block diagram of a spatial extension processing block 40 according to an alternative embodiment of the invention is shown. The processing block of FIG. 5*c* is modified by replacing the delay unit 42 with an all-pass filter APF. A delay or an all-pass filter is applied to CF(t), thereby creating a phase-shifted center channel signal. The phase-shifted center channel signal is subtracted from CF(t) producing the right output. The phase-shifted center channel signal is added to CF(t) producing the left output. Variations of the spatial extension processing block 40 may be realized by replacing the APF with another single-input, single-output all-pass network. Alternative methods for constructing single-input, single-output all-pass networks may be applied in embodiments of the spatial extension blocks described in FIG. 5*a* or FIG. 5*d*. These methods include cascading a plurality of multiple single-input, single-output all-pass networks and/or replacing or cascading any delay unit in an all-pass network filter with another all-pass network.

Figure 6:
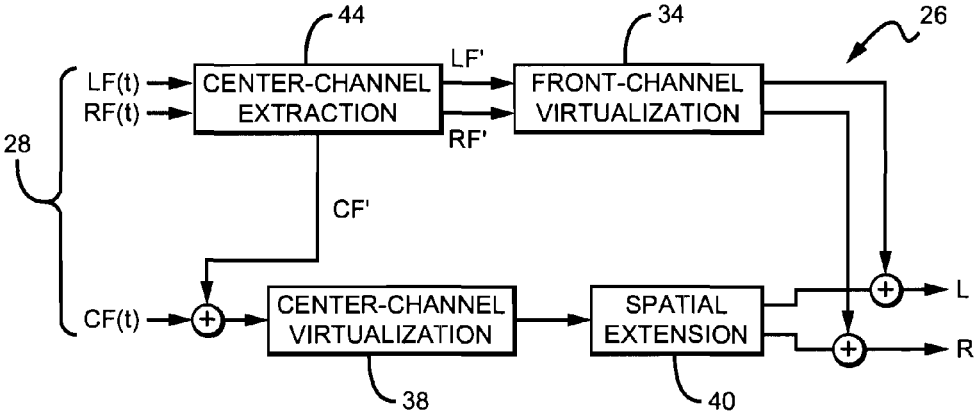
FIG. 6 is a block diagram of a virtual audio processing apparatus including a center channel extraction block for extracting a center channel signal from right and left channel signals.

Referring now to FIG. 6, another embodiment of the front-channel and center-channel virtualization processing included in apparatus 26 is shown. This embodiment is preferred when the audio source signal 28 does not include a discrete center-channel signal CF(t). A center-channel extraction processing block 44 is inserted prior to the front-channel virtualization processing block 34. The center-channel extraction processing block 44 receives the front-channel signal pair, denoted LF(t), RF(t), and outputs three signals LF', RF' and CF'. The audio signal CF' is the extracted center-channel audio signal, which contains the audio signal components that are common to the original left and right input signals LF and RF (or "center-panned"). The audio signal LF' contains the audio signal components that are localized (or "panned") to the left in the original two-channel input signal (LF, RF). Similarly, the audio signal RE' contains the audio signal components that are localized (or "panned") to the right in the input signal (LF, RF). The three signals LE', RF' and CF' are then processed in the same manner as in the virtual audio processing apparatus 26 of FIG. 3. Optionally, the extracted center-channel signal CF' may be combined additively with a discrete center-channel input signal CF(t), so that the same virtual audio processing apparatus 26 may also be employed for processing multi-channel input signals that include an original center-channel signal.

Figure 7:
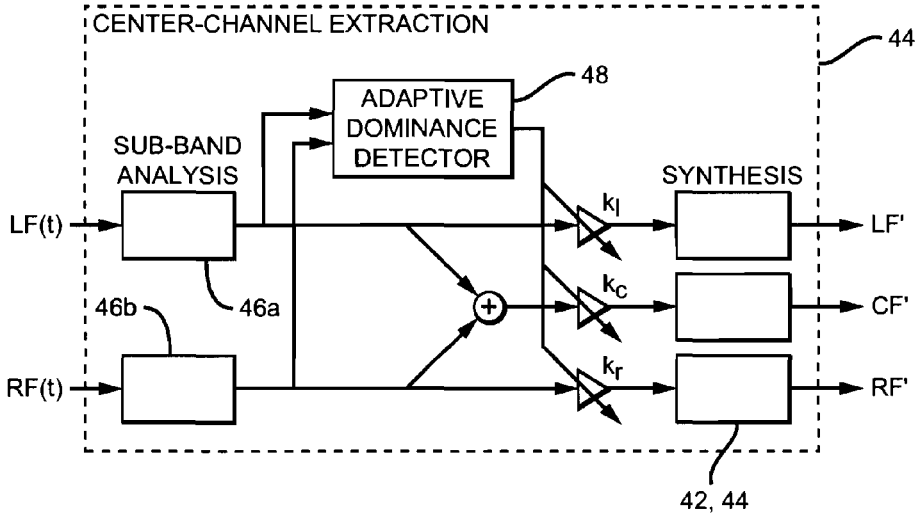
FIG. 7 is a block diagram of a center-channel extraction processing block performing sub-band analysis.

Now referring to FIG. 7, a block diagram of an embodiment of the center-channel extraction processing block 44 is shown. The audio source channel signals LF(t) and RF(t) are processed by optional sub-band analysis stages 46*a*, 46*b* which decompose the signals into a plurality of sub-band audio signals associated to different frequency bands. In embodiments that include these sub-band analysis stages 46*a*, 46*b*, the center-channel extraction process is performed separately for each frequency band, and a synthesis block may optionally be provided for recombining the sub-band output signals corresponding to each of the three output channels LF(t), RF(t) and CF(t) into the full-band audio signals LE', RF' and CF'. In one embodiment, the center-channel extraction process is performed by:

$$LF'=k_L*LF;\ RF'=k_R*RF;\ CF'=k_C*(LF+RF);$$

wherein $k_L$ represents the scaling coefficient for the LF' signal, $k_R$ represents the scaling coefficient for the RF' signal, and $k_C$ represents the scaling coefficient for the CF' signal. In one embodiment, the scaling coefficients $k_L$, $k_R$ and $k_C$ are adaptively computed by an adaptive dominance detector block 48 which continuously evaluates the degree of inter-channel similarity M between the input channels, raises the value of $k_C$ when the inter-channel similarity is high, and reduces the value of $k_C$ when the inter-channel similarity is low. Concurrently, the adaptive dominance detector block reduces the values of $k_L$ and $k_R$ when the inter-channel similarity is high and increases these values when the inter-channel similarity is low. In one embodiment of the invention, the inter-channel similarity index M is defined by:

$$M=\log\left[|LF+RF|^2/|LF-RF|^2\right]$$

Figure 8:
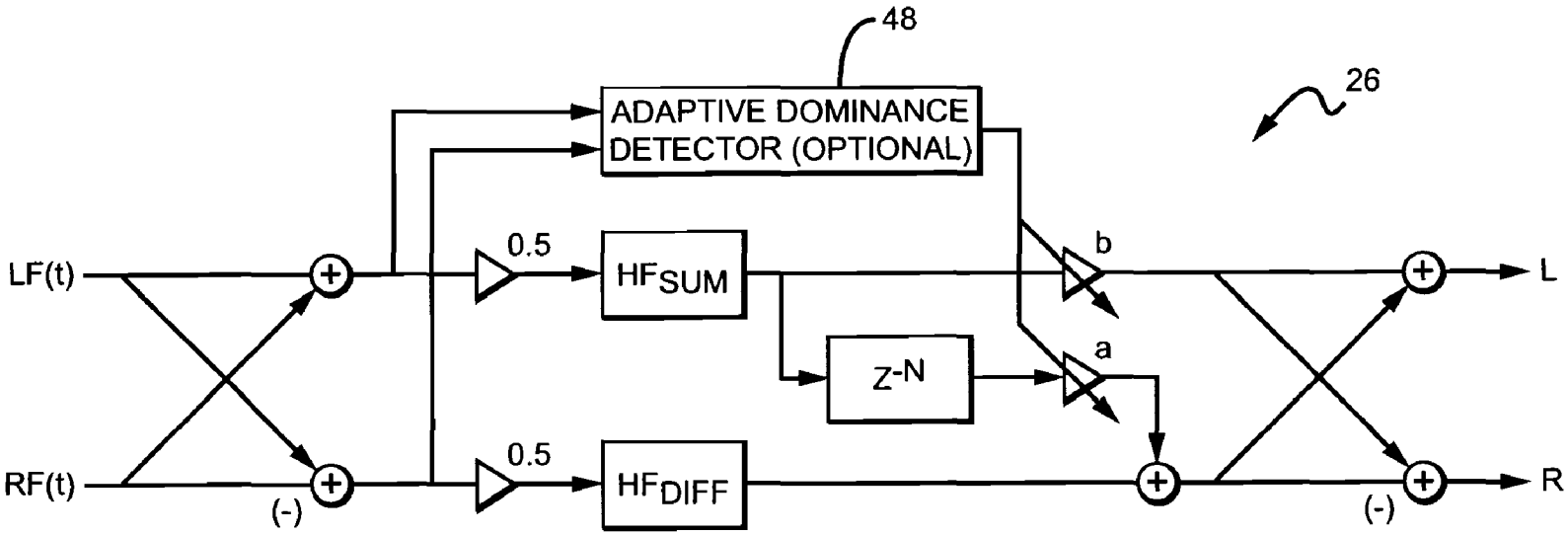
FIG. 8 is a block diagram of a virtual audio processing apparatus having a spatial extension and channel virtualizer in the same processing block.

Now referring to FIG. 8, a block diagram of virtual audio processing apparatus 26 according to an alternative embodiment is shown. The spatial extension processing block 40 and the front-channel virtualization processing block 34 of FIG. 3*a* are combined in a single processing block. The spatial extension processing is applied to the output of the filter $HF_{SUM}$, which is derived from the sum of the audio source channel signals LF(t) and RF(t). A delay or an all-pass filter is applied to CF(t), thereby creating a phase-shifted center channel signal. The phase-shifted center channel signal is subtracted from CF(t) producing the right output. The phase-shifted center channel signal is added to CF(t) producing the left output. The difference of the right and left side channel signals are processed by $HF_{(DIFF)}$ to produce a filtered difference signal. The filtered difference signal is summed with the phase-shifted center channel signal. The optional adaptive dominance detector 48 continually adjusts the degree of spatial extension according to the inter-channel similarity index M. Optionally, as in FIG. 7, the input signals LF(t) and RF(t) may be pre-processed by a sub-band analysis block (not shown in FIG. 8) and the output signals L and R may be post processed by a synthesis block to recombine sub-band signals into full-band signals.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show particulars of the present invention in more detail than is necessary for the fundamental understanding of the present invention, the description taken with the drawings making apparent to those skilled in the art how the several forms of the present invention may be embodied in practice.

What is claimed is:

1. A method for processing audio signals comprising the steps of:

receiving at least one audio signal having at least a center channel signal, a right side channel signal, and a left side channel signal;

processing the right and left side channel signals with a first virtualizer processor, thereby creating a right virtualized channel signal and a left virtualized channel signal;

processing the center channel signal with a spatial extensor to produce distinct right and left outputs, thereby expanding the center channel with a pseudo-stereo effect, further comprising the steps of:

applying a delay or an all-pass filter to the center channel signal, thereby creating a phase-shifted center channel signal;

subtracting the phase-shifted center channel signal from the center channel signal to produce the right output;

adding the phase-shifted center channel signal to the center channel signal to produce the left output; and scaling the center channel signal based on at least one coefficient which determines a perceived amount of spatial extension; and summing the right output with the right virtualized channel signal, and the left output with the left virtualized channel signal, to produce at least one modified side channel output.

2. The method of claim 1, wherein the at least one coefficient is determined by multiplication factors a and b verifying $$a^2+b^2=c;$$

wherein c is equal to a predetermined constant value.

3. The method of claim 2, wherein the predetermined constant value is 0.5.

4. The method of claim 1, wherein the at least one audio signal further comprises a right surround side channel signal and a left surround side channel signal.

5. The method of claim 4, wherein the right and left surround side channel signals are processed by a second virtualizer processor, thereby creating a right surround virtualized channel signal and a left surround virtualized channel signal.

6. The method of claim 5, further comprising the step:

summing the right output with the right surround virtualized channel signal, and the left output with the left surround virtualized channel signal, to produce at least one modified side channel output.

7. The method of claim 1, wherein the virtualizer processor includes a first HRTF filter represented as $H_{(SUM)}$ and a second HRTF filter represented as $H_{(DIFF)}$, wherein $H_{(SUM)}$ and $H_{(DIFF)}$ include the transfer functions:

$$H_{(SUM)}=[H_i+H_c]/[H_{0i}+H_{0c}];$$

$$H_{(DIFF)}=[H_i-H_c]/[H_{0i}-H_{0c}];$$

wherein $H_i$ is an ipsilateral HRTF for a left or right virtual loudspeaker location, $H_c$ is a contralateral HRTF for the left or right virtual loudspeaker location; $H_{0i}$ is an ipsilateral HRTF for a left or right physical loudspeaker location, $H_{0c}$ is a contralateral HRTF for the left or right physical loudspeaker location.

8. The method of claim 1, wherein the summing step produces at least two modified side channel output signals for playback over headphones.

9. An audio signal processing apparatus comprising:

at least one audio signal having at least a center channel signal, a right side channel signal, and a left side channel signal;

a processor for receiving the right and left side channel signals, the processor processing the right and left side channel signals with a first virtualizer processor, thereby creating a right virtualized channel signal and a left virtualized channel signal;

a spatial extensor for receiving the center channel signal, and processing the center channel signal to produce distinct right and left output signals thereby expanding the center channel with a pseudo-stereo effect; wherein the spatial extensor applies a delay or an all-pass filter to the center channel signal thereby creating a phase-shifted center channel signal, and subtracting the phase-shifted center channel signal from the center channel signal to produce the right output; the spatial extensor adds the phase-shifted center channel signal to the center channel signal to produce the left output and scales the center channel signal based on at least one coefficient which determines a perceived amount of spatial extension; and a mixer for summing the right output with the right virtualized channel signal, and the left output with the left virtualized channel signal, to produce at least one modified side channel output.

10. The audio signal processing apparatus of claim 9, wherein the audio signal includes a right surround side channel signal and a left surround side channel signal.

* * * * *